US009466897B1

(12) United States Patent
Wu

(10) Patent No.: US 9,466,897 B1
(45) Date of Patent: Oct. 11, 2016

(54) DOUBLE-WIRE TERMINAL BLOCK STRUCTURE

(71) Applicant: DINKLE ENTERPRISE CO., LTD., New Taipei (TW)

(72) Inventor: Shang-Tsai Wu, New Taipei (TW)

(73) Assignee: DINKLE ENTERPRISES CO., LTD., New Taipei (TW)

( * ) Notice: Subject to any disclaimer, the term of this patent is extended or adjusted under 35 U.S.C. 154(b) by 0 days.

(21) Appl. No.: 15/057,975

(22) Filed: Mar. 1, 2016

(51) Int. Cl.
*H01R 4/02* (2006.01)
*H01R 9/24* (2006.01)
*H01R 4/48* (2006.01)

(52) U.S. Cl.
CPC ..... *H01R 9/2416* (2013.01); *H01R 9/2491* (2013.01); *H01R 4/4827* (2013.01); *H01R 4/4836* (2013.01); *H01R 4/4845* (2013.01)

(58) Field of Classification Search
CPC . H01R 4/4827; H01R 4/4836; H01R 4/4845
USPC ..... 439/835
See application file for complete search history.

(56) References Cited

U.S. PATENT DOCUMENTS 6,595,809 B2 * 7/2003 Matsumoto ..... H01R 4/4827 439/372
9,124,034 B2 * 9/2015 Kollmann ..... H01R 4/4836
9,343,828 B2 * 5/2016 Bishop ..... H01R 4/4818

FOREIGN PATENT DOCUMENTS

JP WO2013/168335 A1 * 11/2013 ..... H01R 4/4836
JP WO2013/168340 A1 * 11/2013 ..... H01R 4/4836

* cited by examiner

*Primary Examiner* — Tho D Ta
(74) *Attorney, Agent, or Firm* — Chun-Ming Shih; HDLS IPR Services

(57) ABSTRACT

A double-wire terminal block structure includes an insulation housing, a conductive terminal block, and a clamp terminal block. The insulation housing includes a press hole and a press block movable with respect to the press hole. The conductive terminal block has a base and two extension arms bent and extending from the base. The clamp terminal block includes a base plate positioned on the base, two flexible arms bent from the base plate, and a contact portion connected to each flexible arm. The press block passes through between the two flexible arms to press each contact portion, so that the two flexible arms are resiliently released from contact with the two extension arms to allow wires to be inserted and clamped between the flexible arms and the extension arms. Accordingly, connecting wire can be achieved easily, conveniently, and efficiently.

10 Claims, 6 Drawing Sheets

DOUBLE-WIRE TERMINAL BLOCK STRUCTURE

TECHNICAL FIELD

The present invention relates to a terminal block structure and, in particular, to a double-wire terminal block structure capable of connecting two wires at the same time.

BACKGROUND

A terminal block is an electronic component extensively used on various machines for connecting a power line, control line or data transmission line. The terminal block used to connect wires includes a body, an upper base and a lower base. The lower base is disposed in an opening of the body; the upper base is slidably disposed in the opening and is slidable with respect to the lower base. When the upper base slidably moves in the opening to be away from the lower base, the wire can be inserted between the upper base and the lower base in order to be electrically connected.

However, the conventional terminal block does not provide plug connection, so it is necessary to screw-fasten or weld a socket onto the terminal block additionally for a plug to make plug connection to transmit out signal, power or data of the wire. In other words, the conventional terminal block fails to provide the following three functions at the same time, i.e. establishing electrical connection, providing a positioning leg for welded to a circuit board, and providing a socket. Furthermore, in the conventional terminal block, the independent socket is secured to the terminal block by screw-fastening or welding; however, such securement methods tend to cause stability, reliability or other problems with the connection between the socket and the plug.

In addition, the present single terminal block merely connects a single wire, so such application already cannot satisfy the market demands. There is a strong demand to get more wires electrically coupled to the terminal block while achieving the above-mentioned functions and other functions. Accordingly, the inventor made various studies to solve the above-mentioned problems, on the basis of which the present invention is achieved.

SUMMARY

It is an object of the present invention to provide a double-wire terminal block structure, whereby wires can be connected in a more convenient, time-saving, and efficient way.

It is another object of the present invention to provide a double-wire terminal block structure having a socket and an insulation housing which are integrally formed.

Accordingly, the present invention provides a double-wire terminal block structure, comprising an insulation housing, a conductive terminal block, and a clamp terminal block. The insulation housing includes an accommodating trough, two wiring holes, a press hole, a press block movable with respect to the press hole, and a socket adjacent to the accommodating trough. The accommodating trough communicates with the two wiring holes and the press hole. The conductive terminal block includes a base positioned at the bottom of the accommodating trough, two extension arms bent and extending from the base, and an insertion lead extending from between the two extension arms toward the socket. The clamp terminal block includes a base plate positioned at the base, two flexible arms bent and extending from the base plate, and a contact portion connected to an inner side of one end of each of the flexible arms, wherein the press block passes through between the two extension arms to press each of the contact portions to resiliently release the two flexible arms from contact with the two extension arms.

It is preferable that the base further includes two positioning portions protruding therefrom and includes an aperture between the two positioning portions, the base plate includes two openings corresponding to the two positioning portions, and the positioning portions are engaged with the openings respectively.

It is preferable that each of the extension arms further includes an upright section and a horizontal section connected to the upright section, and the horizontal section is disposed horizontally in parallel relation to the base.

It is preferable that each of the contact portions further includes a fixed portion connected to an inner side edge of the flexible arm and includes a bending portion connected to one end of the fixed portion, and the bending portion is bent toward the insertion lead.

The present invention further has the following effects. The insertion lead, the first leg and the second leg of the conductive terminal block are produced by press molding the base directly, so multiple functions can be achieved, such as electrically coupling the connection plug to the insertion lead in the socket, and using the first leg and the second leg to facilitate welding to the circuit board (not illustrated). Each contact portion of the clamp terminal block is formed by press molding each flexible arm to become a split structure for being pressed by the press block. Therefore, by utilizing the press-molded conductive terminal block and the clamp terminal block, the present invention greatly saves a material cost and reduces the component number, and thereby assembly is convenient, time-saving, and efficient.

BRIEF DESCRIPTION OF THE DRAWINGS

The disclosure will become more fully understood from the detailed description, and the drawings given herein below are for illustration only, and thus does not limit the disclosure, wherein.

DETAILED DESCRIPTION

Figure 1:
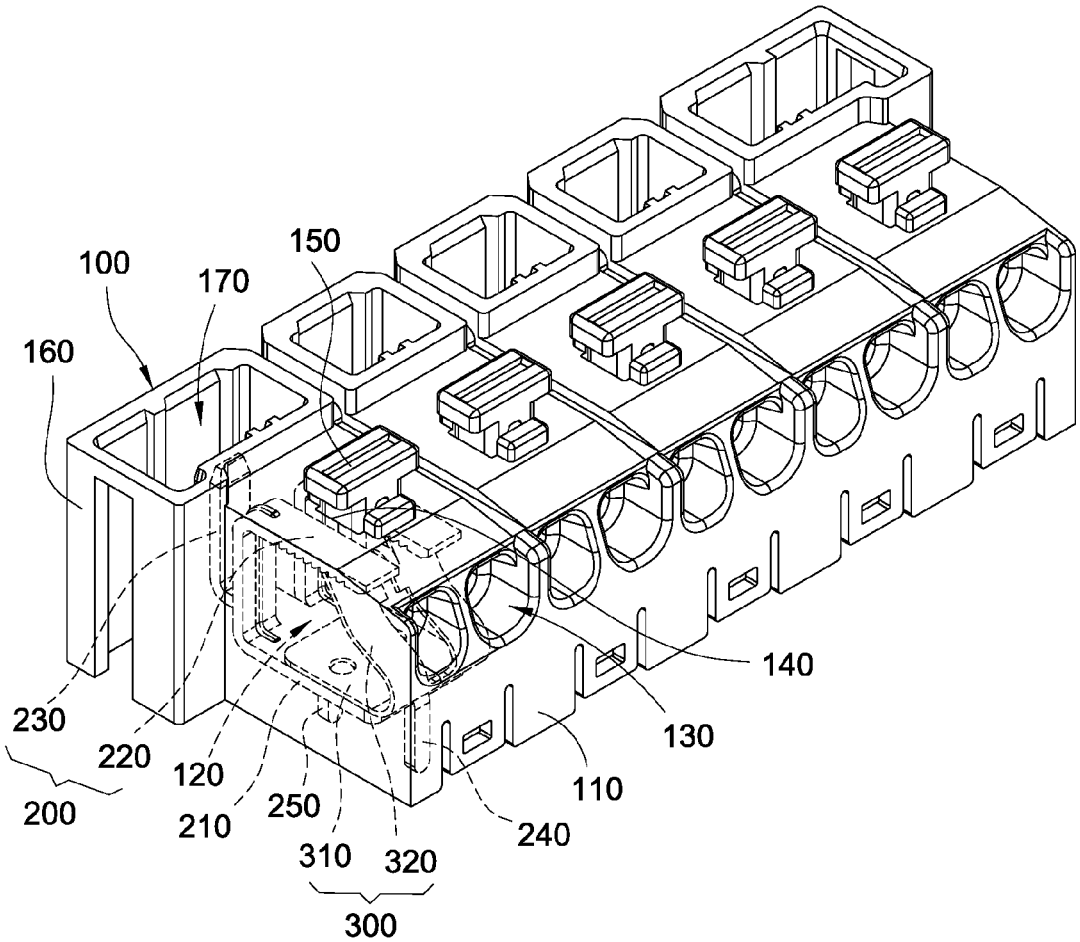
FIG. 1 is a perspective view of the present invention, showing multiple double-wire terminal block structures arranged in parallel.

Detailed descriptions and technical contents of the present invention are illustrated below in conjunction with the accompany drawings. However, it is to be understood that the descriptions and the accompany drawings disclosed herein are merely illustrative and exemplary and not intended to limit the scope of the present invention.

Referring to FIGS. 1 to 6, the present invention provides a double-wire terminal block structure 100 for electrically coupled to two wires 400 and transmitting data, signals or power by connecting a connection plug 500 having a pair of connection terminals 510. According to the embodiment shown in FIG. 1, it is preferable to use a plurality of double-wire terminal block structures 100 arranged in parallel; the quantity varies depending on requirement. For the purpose of simplicity, only one double-wire terminal block structure 100 is described hereinafter as an example.

As shown in FIG. 1, the double-wire terminal block structure 100 includes an insulation housing 110, a conductive terminal block 200, and a clamp terminal block 300. The insulation housing 110 includes an accommodating trough 120, two wiring holes 130, a press hole 140, a press block 150 movable with respect to the press hole 140, and a socket 160 adjacent to the accommodating trough 120. The accommodating trough 120 communicates with the two wiring holes 130 and the press hole 140. In the present embodiment, the socket 160 further includes an insertion hole 170, the insertion hole 170 and the press hole 140 are open at the top of the insulation housing 110, and the socket 160 is disposed at the other side of the insulation housing 110 opposite to the two wiring holes 130.

Figure 2:
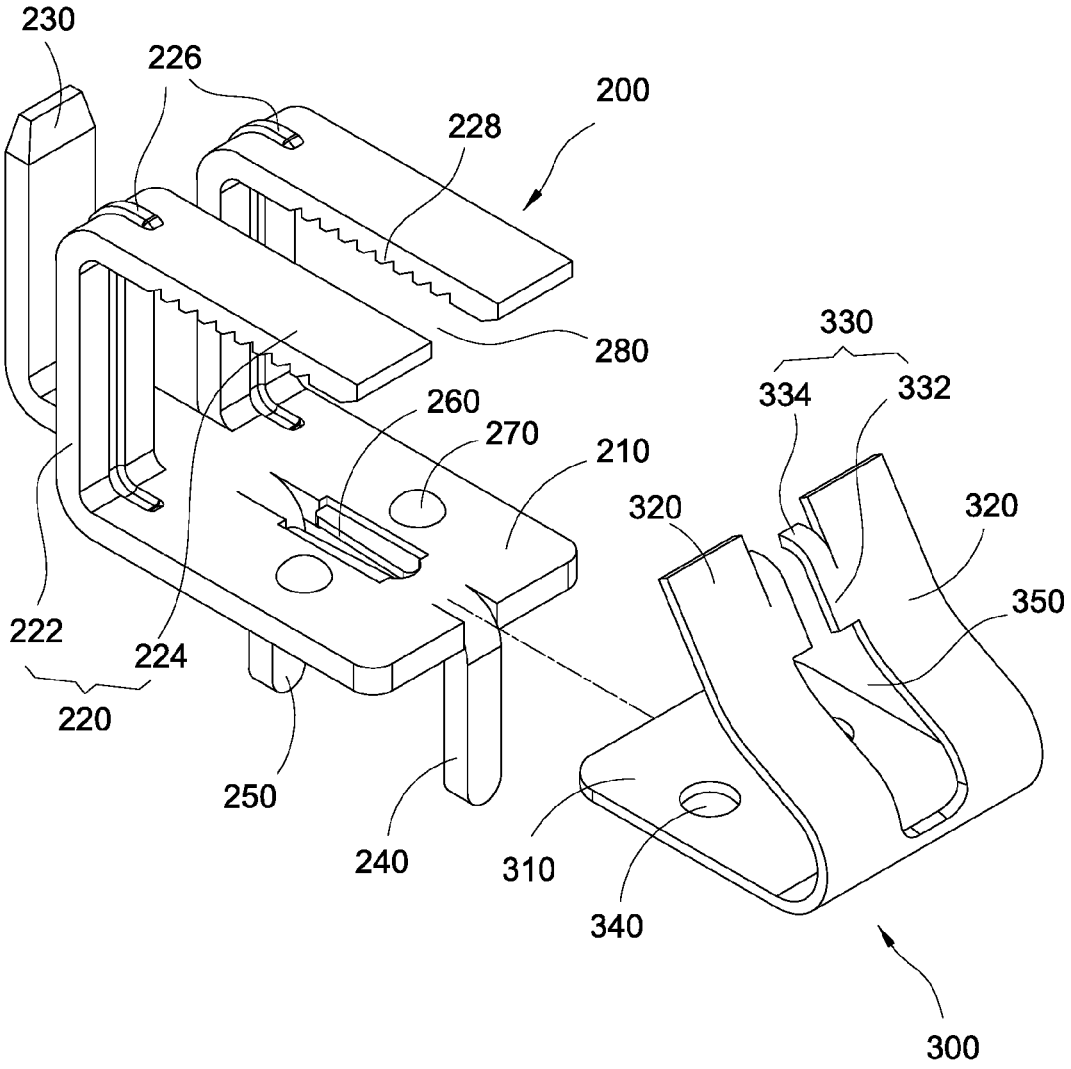
FIG. 2 is a perspective exploded view of the present invention, showing a conductive terminal block and a clamp terminal block.
Figure 3:
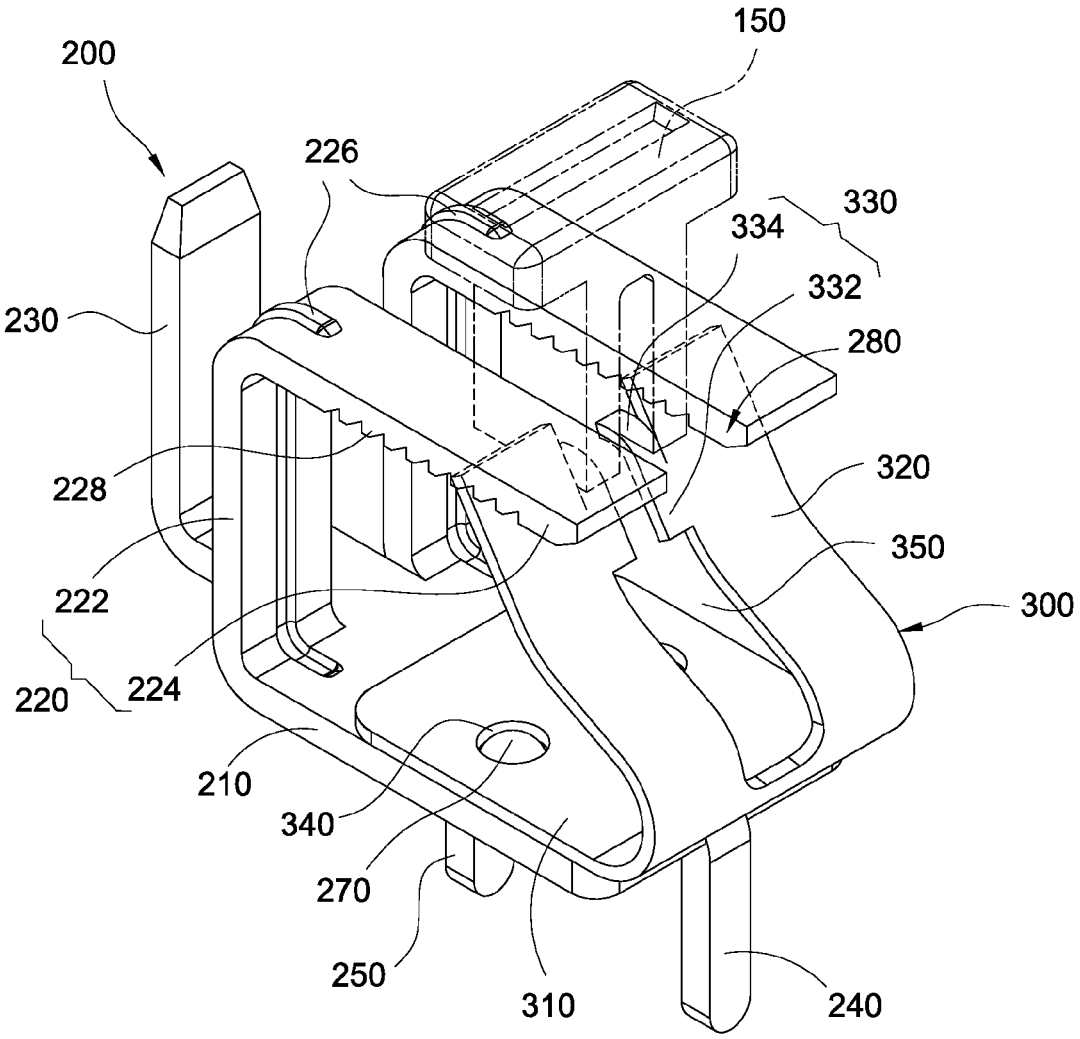
FIG. 3 is a schematic view of the present invention, showing the conductive terminal block and the clamp terminal block assembled together.
Figure 4:
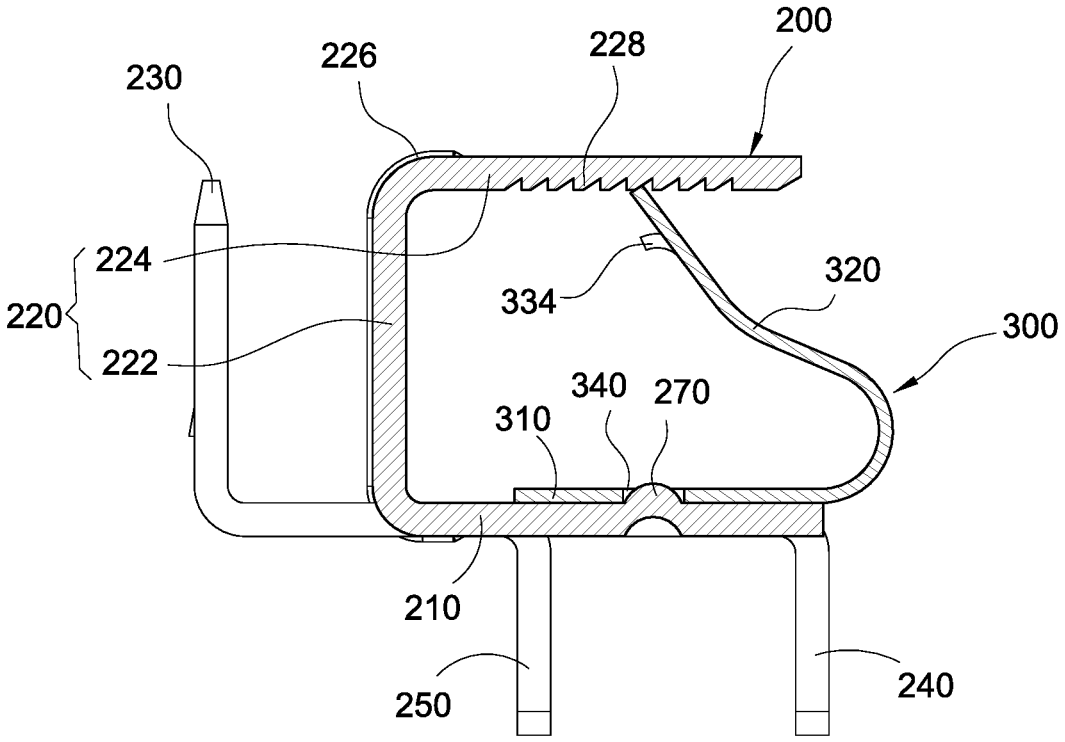
FIG. 4 is a cross-sectional view of the present invention, showing the conductive terminal block and the clamp terminal block.

Referring to FIGS. 2 to 4, the conductive terminal block 200, preferably made of metal or alloy thereof, includes a base 210 positioned at the bottom of the accommodating trough 120, two extension arms 220 bent and extending from the base 210, and an insertion lead 230 extending from between the two extension arms 220 toward and preferably into the socket 160. The clamp terminal block 300, preferably made of metal or alloy thereof, includes a base plate 310 positioned at the base 210, two flexible arms 320 bent and extending from the base plate 310, and a contact portion 330 connected to an inner side of one end of each of the flexible arms 320.

The base 210 further includes two positioning portions 270 and an aperture 260 between the two positioning portions 270. The base plate 310 includes two openings 340 corresponding to the two positioning portions 270, the positioning portions 270 are engaged with the openings 340 respectively, so the base plate 310 of the clamp terminal block 300 can be stably positioned on the base 210 of the conductive terminal block 200. In the present embodiment, it is preferable that the two positioning portions 270 are of round shape, and the two openings 340 are correspondingly circular shaped. However, in other embodiments, the positioning portions 270 and the openings 340 can be oval or triangle shaped, or in other suitable shape; the present invention is not limited in this regard.

Each of the extension arms 220 further includes an upright section 222 and a horizontal section 224 connected to the upright section 222. The horizontal section 224 is disposed horizontally in parallel relation to the base 210. An inner surface of each of the horizontal sections 224 further includes a plurality of teeth 228 to enhance a clamping force applied to the wire (not illustrated). An outer surface of each of the upright sections 222 further includes a rib 226 to enhance structural strength of the extension arm 220 and also enhance whole supporting strength of the insulation housing 110.

Furthermore, the contact portion 330 further includes a fixed portion 332 connected to an inner side edge of the flexible arm 320 and includes a bending portion 334 connected to the fixed portion 332; the bending portion 334 is bent toward the insertion lead 230. As shown in FIGS. 2 and 3, a first gap 280 is provided between the two extension arms 220, a second gap 350 is provided between the two flexible arms 320, and the first gap 280 and the second gap 350 are disposed corresponding to each other. The insertion lead 230 extends from a direction of the first gap 280. As shown in the drawings, the press block 150 passes through the first gap 280 between the two extension arms 220 to press each contact portion 330, so that the two flexible arms 320 are resiliently released from contact with the two extension arms 220, as also referring to FIGS. 5 and 6.

Figure 5:
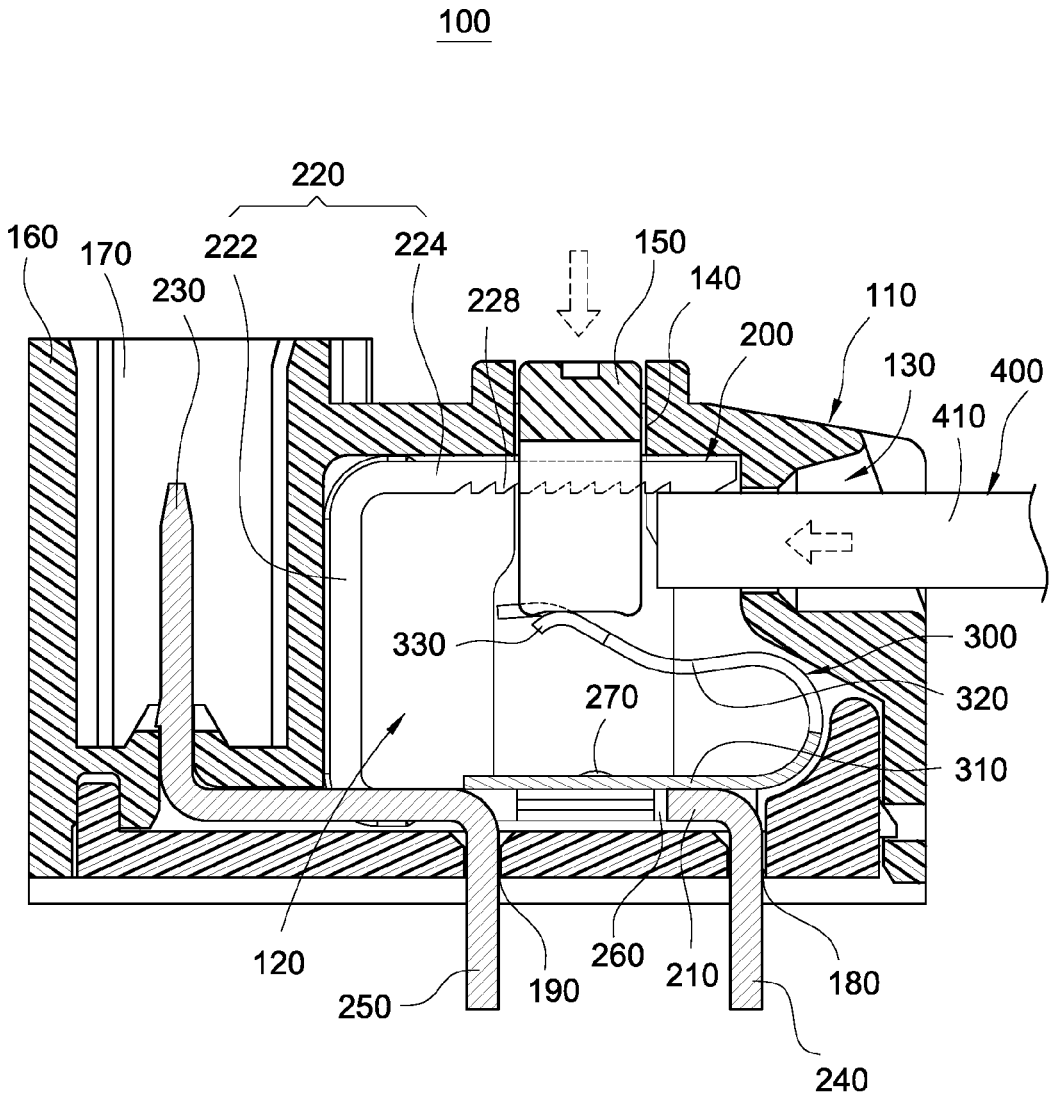
FIG. 5 is a cross-sectional view of the present invention, showing pressing down a press block to separate a flexible arm from an extension arm.
Figure 6:
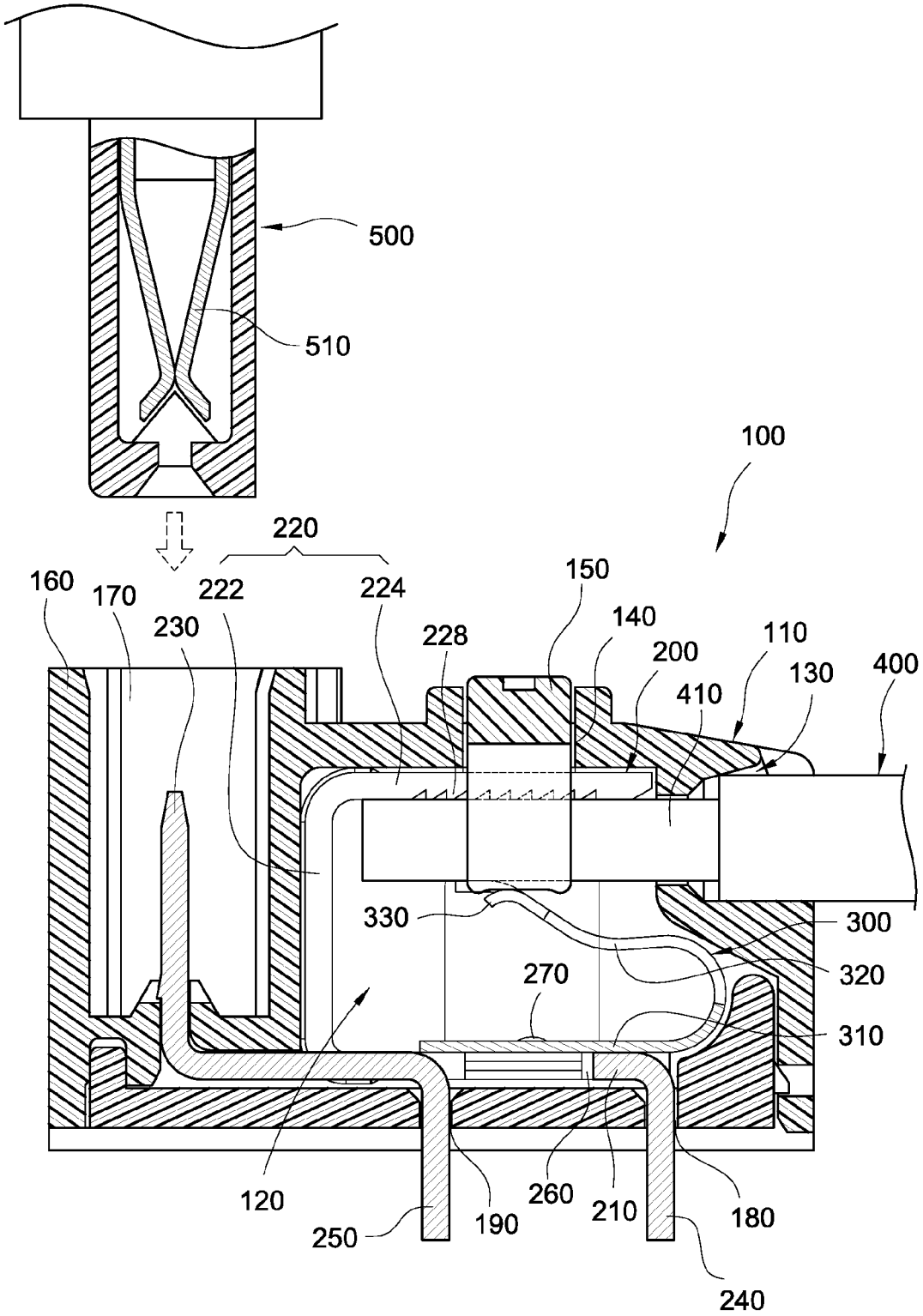
FIG. 6 is a cross-sectional view of the present invention, showing the clamp terminal block clamping a wire on the conductive terminal block, and showing a connection plug for coupled with a socket.

The conductive terminal block 200 further includes a first leg 240 and a second leg 250 bent and extending from the base 210. The first leg 240 and the second leg 250 are disposed corresponding and parallel to each other for welded to a circuit board (not illustrated). One side of the insulation housing 110 opposite to the press hole 140 includes a first positioning hole 180 and a second positioning hole 190. As shown in FIGS. 5 and 6, the first leg 240 is vertically inserted, from one end of the base 210, into the first positioning hole 180 to be positioned therein, one end of the second leg 250 is vertically connected to the base 210, and the other end of the second leg 250 is bent away from the aperture 260 and positioned in the second positioning hole 190.

As shown in FIG. 5, the press block 150 of the insulation housing 110 is movable in the press hole 140, the movement direction of the press block 150 being perpendicular to a direction of inserting the two wires 400 into the two wiring holes 130. The two wires 400 are clamped between the two flexible arms 320 and the two extension arms 220, so data, signal or power of the two wires 400 can be transmitted to the insertion lead 230. The insertion lead 230 is bent and extends from between two extension arms 220 toward the socket 160 and is parallel to the first leg 240 and the second leg 250.

When the press block 150 movably presses each contact portion 330 in the press hole 140, the two flexible arms 320 resiliently move away from the two extension arms 220. At this point, the wire 400 having a core 410 is inserted in from the wiring hole 130. After the press block 150 is released, the two flexible arms 320 return resiliently to clamp the core 410, so the wire 400 is secured tightly and is electrically connected between the flexible arm 320 and the extension arm 220, as shown in FIG. 6.

The embodiment shown in FIG. 6 further includes a connection plug 500 having a pair of connection terminals 510 for being inserted into the insertion hole 170 of the socket 160, so that the insertion lead 230 is electrically coupled to the two connection terminals 510, so as to transmit the data, signal or power of the wire 400 via the connection plug 500 to an electronic device (not illustrated) connected thereto.

In the present invention, the two flexible arms 320 are pressed down at the same time by pressing the press block 150, so connecting the two wires 400 can be achieved in a much more convenient, time-saving, and efficient way. Furthermore, in the present invention, the insertion lead 230, the first leg 240 and the second leg 250 of the conductive terminal block 200 are produced by press molding the base 210 directly, so multiple functions can be achieved, such as electrically coupling the connection plug 500 to the insertion lead 230 in the socket 160, and using the first leg 240 and the second leg 250 to facilitate welding to the circuit board (not illustrated). Each contact portion 330 of the clamp terminal block 300 is produced by press molding each flexible arm 320 to become a split structure for being pressed by the press block 150. Therefore, by utilizing the press-molded conductive terminal block 200 and the clamp terminal block 300, the present invention greatly saves a material cost and reduces the component number, and thereby assembly is convenient, time-saving, and efficient.

It is to be understood that the above descriptions are merely the preferable embodiments of the present invention and are not intended to limit the scope of the present invention. Equivalent changes and modifications made in the spirit of the present invention are regarded as falling within the scope of the present invention.

What is claimed is:

1. A double-wire terminal block structure, comprising:

an insulation housing, the insulation housing including an accommodating trough, two wiring holes, a press hole, a press block movable with respect to the press hole, and a socket adjacent to the accommodating trough, the accommodating trough communicating with the two wiring holes and the press hole;

a conductive terminal block, the conductive terminal block including a base positioned at a bottom of the accommodating trough, two extension arms bent and extending from the base, and an insertion lead extending from between the two extension arms toward the socket; and a clamp terminal block, the clamp terminal block including a base plate positioned at the base, two flexible arms bent and extending from the base plate, and a contact portion connected to an inner side of one end of each of the flexible arms, wherein the press block passes through between the two extension arms to press each of the contact portions to resiliently release the two flexible arms from contact with the two extension arms.

2. The double-wire terminal block structure of claim 1, wherein the base further includes two positioning portions protruding therefrom and includes an aperture between the two positioning portions, the base plate includes two openings corresponding to the two positioning portions, and the positioning portions are engaged with the openings respectively.

3. The double-wire terminal block structure of claim 1, wherein each of the extension arms further includes an upright section and a horizontal section connected to the upright section, and the horizontal section is disposed horizontally in parallel relation to the base.

4. The double-wire terminal block structure of claim 1, wherein each of the contact portions further includes a fixed portion connected to an inner side edge of the flexible arm and includes a bending portion connected to one end of the fixed portion, and the bending portion is bent toward the insertion lead.

5. The double-wire terminal block structure of claim 1, wherein a movement direction of the press block in the press hole is perpendicular to a direction of inserting two wires into the two wiring holes, and each of the two wires is clamped between each of the two flexible arms and each of the two extension arms.

6. The double-wire terminal block structure of claim 2, wherein the conductive terminal block further includes a first leg and a second leg bent and extending from the base, and the first leg and the second leg are disposed corresponding and parallel to each other.

7. The double-wire terminal block structure of claim 3, wherein an inner surface of each of the horizontal sections further includes a plurality of teeth.

8. The double-wire terminal block structure of claim 6, wherein one side of the insulation housing opposite to the press hole includes a first positioning hole and a second positioning hole.

9. The double-wire terminal block structure of claim 8, wherein the first leg is vertically inserted, from one end of the base, into the first positioning hole to be positioned therein, one end of the second leg is vertically connected to the base, and the other end of the second leg is bent away from the aperture and positioned in the second positioning hole.

10. The double-wire terminal block structure of claim 1, wherein a first gap is provided between the two extension arms, a second gap is provided between the two flexible arms, and the first gap and the second gap are disposed corresponding to each other.

* * * * *